US005291622A

United States Patent [19]

Humpert

[11] Patent Number: 5,291,622

[45] Date of Patent: Mar. 8, 1994

[54] ESCUTCHEON FOR WALL-MOUNT MIXING FAUCET

[75] Inventor: Jurgen Humpert, Hemer, Fed. Rep. of Germany

[73] Assignee: Friedrich Grohe Akteingesellschaft, Hemer, Fed. Rep. of Germany

[21] Appl. No.: 949,701

[22] Filed: Sep. 23, 1992

[30] Foreign Application Priority Data

Oct. 18, 1991 [DE] Fed. Rep. of Germany ..... 4134511

[51] Int. Cl.[5] ..... F16L 5/00

[52] U.S. Cl. ..... 4/678; 137/359; 285/46

[58] Field of Search ..... 4/675, 676, 677, 678, 4/695; 137/359, 360; 285/46

[56] References Cited

U.S. PATENT DOCUMENTS

| | | | |
|---|---|---|---|
| 3,067,436 | 12/1962 | Frabott | 4/675 |
| 3,439,701 | 4/1969 | Stella | 137/359 |
| 4,662,389 | 5/1987 | Igbol | 4/675 |
| 4,678,207 | 7/1987 | Dornbracht et al. | 285/46 |
| 4,842,009 | 6/1989 | Reback | 137/359 |
| 4,989,633 | 2/1991 | Humpert et al. | 137/360 |
| 5,148,551 | 9/2992 | Humpert et al. | 4/677 |

FOREIGN PATENT DOCUMENTS

| | | |
|---|---|---|
| 1216805 | of 0000 | Fed. Rep. of Germany . |
| 3447802 | of 0000 | Fed. Rep. of Germany . |
| 3806492 | of 0000 | Fed. Rep. of Germany . |
| 8707807.4 | of 0000 | Fed. Rep. of Germany . |
| 1900057 | 9/1964 | Fed. Rep. of Germany . |
| 2250000 | of 0000 | France . |

*Primary Examiner*—Henry J. Recla
*Assistant Examiner*—Charles R. Ebshurey
*Attorney, Agent, or Firm*—Herbert Dubno; Andrew Wilford

[57] ABSTRACT

A faucet body mounted on a wall and having a connecting pipe projecting from the wall and having an outer end secured via a faceted nut to the body, has escutcheon with a sleeve centered on an axis, formed with an external screwthread, and formed with at least one axially extending and radially inwardly projecting ridge engageable with facets of the faucet-assembly nut so as to rotationally couple the sleeve to the nut. An outer ring fitting around the sleeve has an internal screwthread meshing with the screwthread of the sleeve and has a rear face. A seal set in and projecting axially rearwardly from the rear face of the ring engages the wall.

6 Claims, 3 Drawing Sheets

ESCUTCHEON FOR WALL-MOUNT MIXING FAUCET

FIELD OF THE INVENTION

The present invention relates to a wall-mount mixing faucet. More particularly this invention concerns an escutcheon plate for such a faucet.

BACKGROUND OF THE INVENTION

A standard mixing-faucet shower body is mounted on a wall with the aid of two offset connecting pipes or fittings that can be rotated to provide the necessary center-to-center spacing. Respective nuts are screwed onto outer portions of these offset pipes to couple same to the faucet body. Clearly these offset pipes are not attractive so it is standard to provide an escutcheon assembly to dress them up.

German utility model 1,900,057 describes an escutcheon assembly comprised of two coaxial telescoping sleeves interconnected by an external screwthread on the rear end of the inner sleeve and an internal screwthread running the entire length of the interior of the outer sleeve. This assembly is screwed down so the inner sleeve is wholly within the outer sleeve and is slipped over the respective pipe prior to connection to the faucet body. Once the connection is made, the two parts are screwed apart to bear outward on the faucet body and inward on the wall, completely filling the space between the wall and the body.

While such an arrangement does indeed provide an attractive appearance once installed, it is quite difficult to extend it during initial installation and to shorten it if later access is needed to the mounting nuts to work on the faucet. Getting a grip on the inner sleeve so it can be rotated relative to the outer sleeve is very difficult.

OBJECTS OF THE INVENTION

It is therefore an object of the present invention to provide an improved escutcheon assembly for a wall-mount mixing faucet.

Another object is the provision of such an improved escutcheon assembly for a wall-mount mixing faucet which overcomes the above-given disadvantages, that is which is easy to install and to shorten for servicing the faucet.

SUMMARY OF THE INVENTION

A faucet body mounted on a wall and having a connecting pipe projecting from the wall and having an outer end secured via a faceted nut to the body has an escutcheon having according to the invention a sleeve centered on an axis, formed with an external screwthread, and formed with at least one axially extending and radially inwardly projecting ridge engageable with facets of the faucet-assembly nut so as to rotationally couple the sleeve to the nut. An outer ring fitting around the sleeve has an internal screwthread meshing with the screwthread of the sleeve and has a rear face. A seal set in and projecting axially rearwardly from the rear face of the ring engages the wall.

Thus with this system the inner sleeve can be slid out to engage over and lock rotationally to the nut, so that subsequent rotation of the ring will screw the two parts relative to each other. The seal will be forced into contact with the wall, making a watertight connection.

According to another feature of the invention the sleeve is formed internally with a plurality of axially extending, radially inwardly projecting, and angularly spaced such ridges spaced to fit loosely around facets of the faucet-assembly nut. These ridges only extend about half the length of the sleeve and are situated mainly on the axial outer half of the sleeve to allow them to be backed off the nut.

In accordance with further features of the invention the ring has an inner wall formed with the internal screwthread, an outer wall, and radially extending webs interconnecting the walls and forming therewith an axially backwardly open annular groove in which the seal is set. Furthermore the ring has an annular inner edge closely juxtaposed with an outer surface of the sleeve and provided with an annular seal engaging the outer sleeve surface. The sleeve is generally cylindrical and formed with an outwardly projecting rim formed with the external screwthread. The shower body is formed around the pipe with an annular recess in which a front edge of the sleeve is received and the sleeve and the ring are of generally the same axial length.

BRIEF DESCRIPTION OF THE DRAWINGS

The above and other objects, features, and advantages will become more readily apparent from the following, reference being made to the accompanying drawing in which.

SPECIFIC DESCRIPTION

Figure 1:
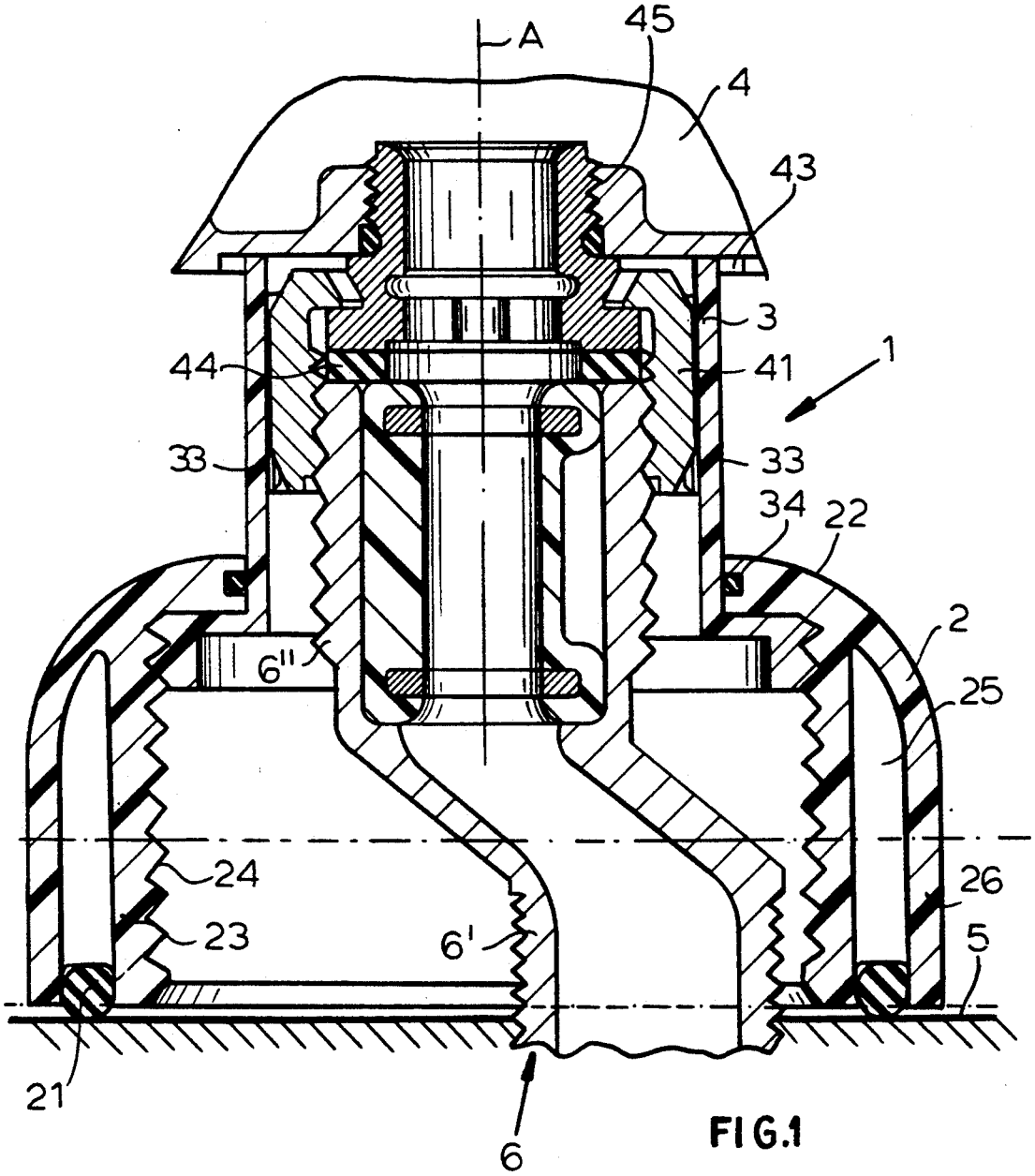
FIG. 1 is an axial section through an escutcheon with the associated valve and wall according to the invention.

As seen in FIG. 1 an escutcheon assembly 1 according to this invention is basically mounted around a connecting pipe 6 extending from a wall 5 to a mixing faucet 4. This pipe 6 has two parallel but offset portions 6′ and 6″ so it can be rotated in the wall 5 to align an axis A of its outer portion 6″ with a seat 45 on the back of the valve 4 in the manner well known. The outer portion 6″ of the pipe 6 is threaded and can be engaged by a nut 41 that itself engages with a lip over the edge of the seat 45 to compress same via a seal ring 44 against the end face of the pipe 6 for a watertight seal.

Figure 2:
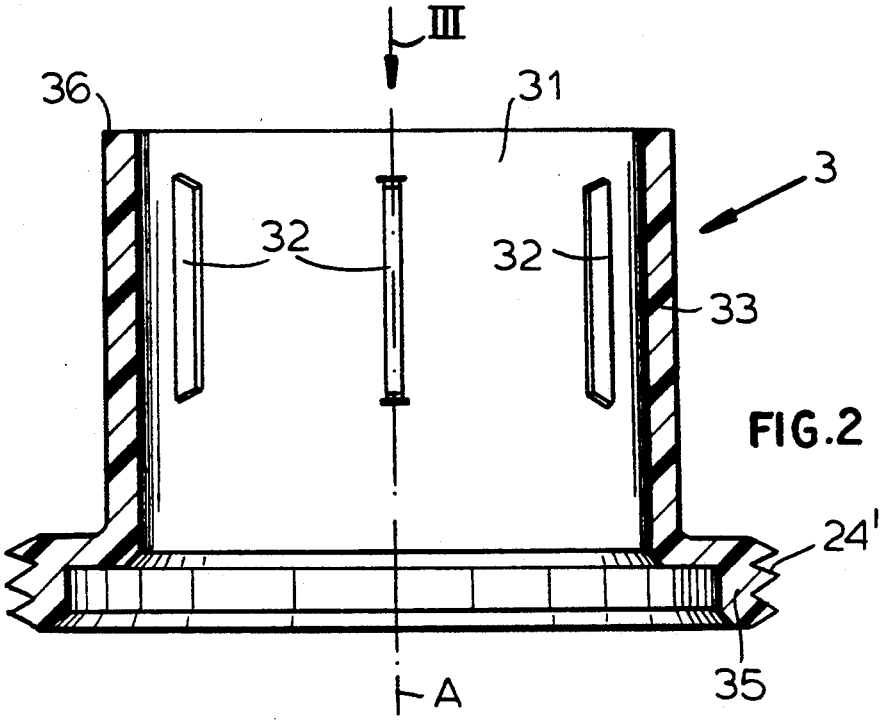
FIG. 2 is an axial section through the inner sleeve part of the escutcheon.
Figure 3:
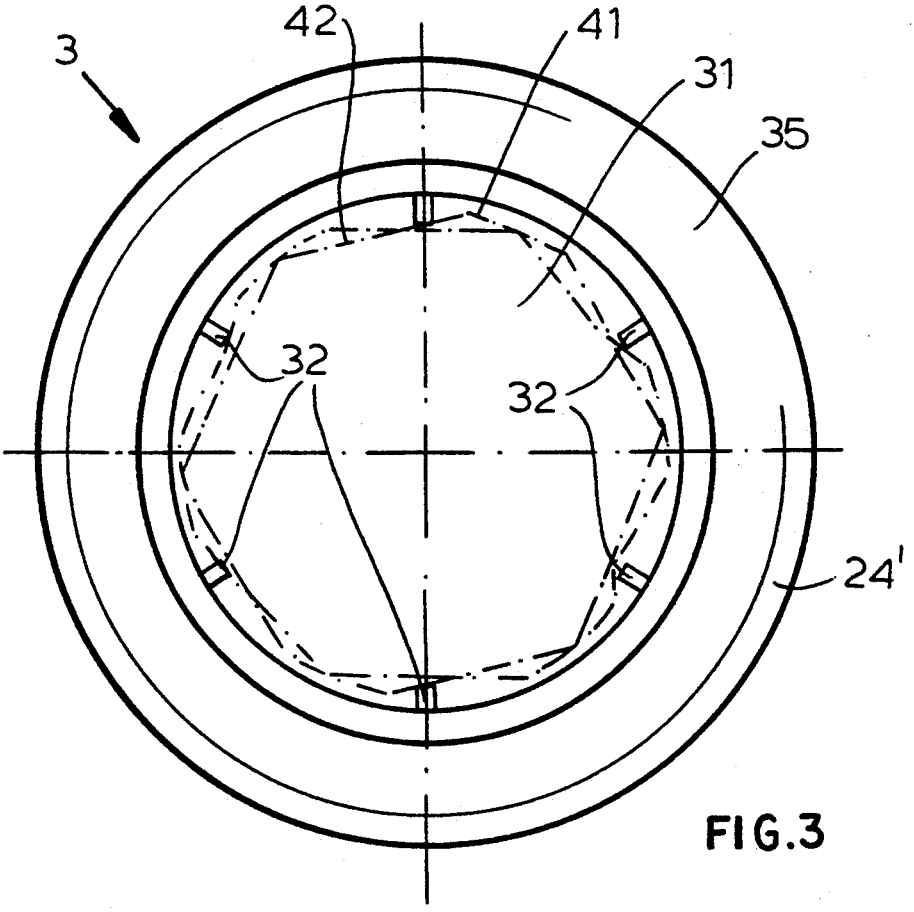
FIG. 3 is a view taken in the direction of arrow III of FIG. 2.
Figure 4:
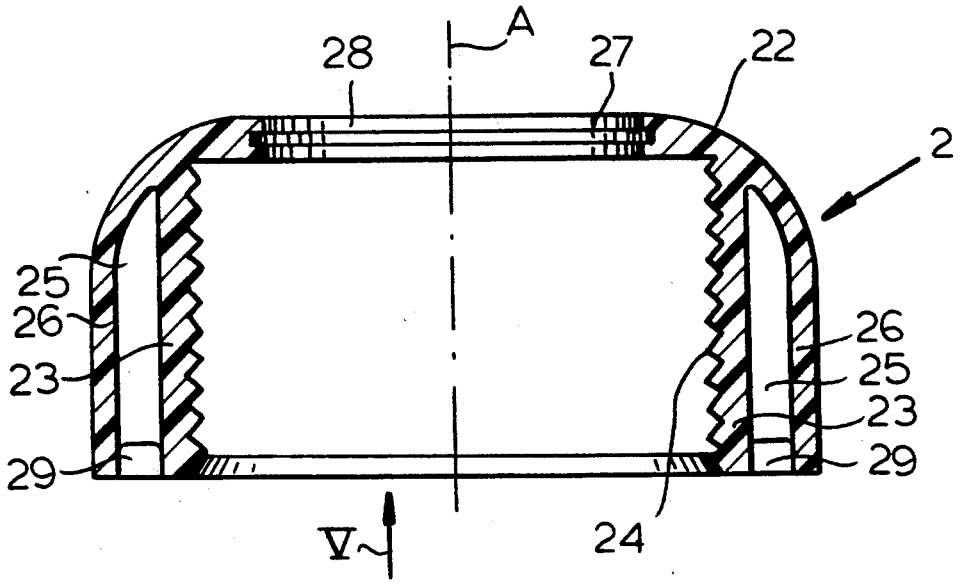
FIG. 4 is a smaller-scale axial section through the outer part of the escutcheon.
Figure 5:
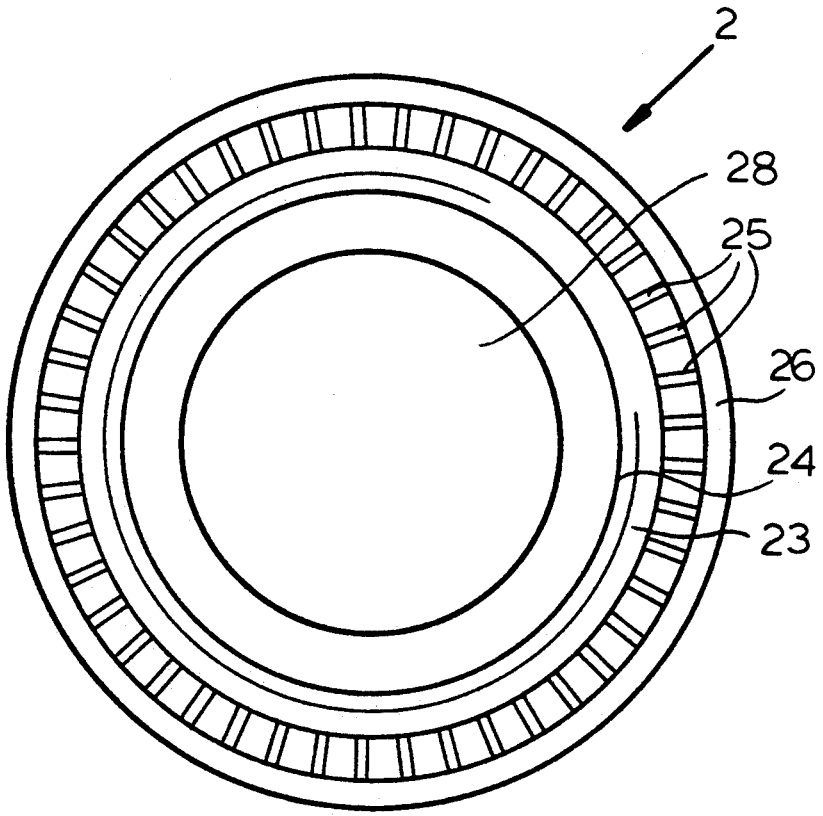
FIG. 5 is a view taken in the direction of arrow V of FIG. 4.

The escutcheon 1 comprises an inner sleeve part 3 having a cylindrical outer surface 33 shown in FIGS. 2 and 3. It is centered on the axis A, has a planar outer end face 36, and an opposite end formed with a radially outwardly projecting rim formed in turn with an external screwthread 24′. The part 3 further has six angularly equispaced, axially extending, and radially inwardly projecting ridges 32 dimensioned to fit loosely around the nut 41 so as to engage facets 42 of same. Thus these ridges 32 can rotationally link the part 3 to the nut 41.

In addition the escutcheon 1 has an outer wall-engaging ring part 2 having a part-spherical outer end portion 22 and a cylindrical side skirt 26. Its outer end is formed with an axially centered passage 28 itself formed with a radially inwardly open groove 27 adapted to receive a seal ring 34 that normally rides on the cylindrical surface 33 of the part 3. Internally the part 2 has an inner wall or skirt 23 formed with an internal screwthread 24 complimentary to the screwthread 24'. Radially extending vanes 25 interconnect the walls 23 and 26 and form an axially rearwardly open groove 29 adapted to receive another seal ring 21 that normally engages the wall 5.

For installation, once the outer part 6'' of the pipe 6 is in the right position to align with the faucet body 4, the escutcheon assembly 1 comprising the parts 2 and 3 and the seal rings 21 and 22 is slipped over the pipe 6, with the inner part 3 screwed all the way down in the outer part 2 so as to reduce its axial dimension to a minimum. This makes it possible to get a wrench on the nut 41 and tighten it. To this end the two parts 2 and 3 of the assembly 1 are about the same axial length so that when screwed together they only have about half of their maximum height.

The entire escutcheon assembly 1 is then pulled outward to seat the end face 36 in a recess 43 surrounding the fitting 45, and to engage the ribs 32 around the nut 41. The outer part 2 is then screwed back since the inner part 3 will be rotationally arrested on the stationary nut 41, until the seal ring 21 is compressed against the wall 5. This completes the installation which is wholly manual.

Subsequent removal of the faucet 4 is fairly easy once the part 2 is screwed back out to shorten the escutcheon 1 and gain access to the nut 41.

I claim:

1. In combination with a faucet body adapted to be mounted on a wall and having a connecting pipe projecting from the wall and having an outer end secured via a faceted nut to the body, an escutcheon comprising:

a sleeve centered on an axis, formed with an external screwthread, and formed with at least one axially extending and radially inwardly projecting ridge engageable with facets of the faucet-assembly nut so as to rotationally couple the sleeve to the nut;

an outer ring fitting around the sleeve, having an internal screwthread meshing with the screwthread of the sleeve, and having a rear face; and a seal set in and projecting axially rearwardly from the rear face of the ring and engageable with the wall.

2. The escutcheon defined in claim 1 wherein the sleeve is formed internally with a plurality of axially extending, radially inwardly projecting, and angularly spaced such ridges spaced to fit around facets of the faucet-assembly nut.

3. The escutcheon defined in claim 1 wherein the ring has an inner wall formed with the internal screwthread, an outer wall, and radially extending webs interconnecting the walls and forming therewith an axially backwardly open annular groove in which the seal is set.

4. The escutcheon defined in claim 1 wherein the ring has an annular inner edge closely juxtaposed with an outer surface of the sleeve and provided with an annular seal engaging the outer sleeve surface, the sleeve being generally cylindrical and formed with an outwardly projecting rim formed with the external screwthread.

5. The escutcheon defined in claim 1 wherein the faucet body is formed around the pipe with an annular recess in which a front edge of the sleeve is received.

6. The escutcheon defined in claim 1 wherein the sleeve and the ring are of generally the same axial length.

* * * * *